United States Patent [19]

Lardenois

[11] 3,970,093

[45] July 20, 1976

[54] APPARATUS FOR TREATMENT AND CARE OF THE HAIR

[75] Inventor: Robert A. Lardenois, Neuilly-sur-Seine, France

[73] Assignee: Etablissements Lardenois, Hermes, France

[22] Filed: Feb. 5, 1975

[21] Appl. No.: 547,211

[30] Foreign Application Priority Data

Feb. 25, 1974 France ..... 74.06273

[52] U.S. Cl. ..... 132/9; 34/97

[51] Int. Cl.[2] ..... A45D 20/00

[58] Field of Search ..... 132/9, 85; 15/187; 34/97

[56] References Cited

UNITED STATES PATENTS

| | | | |
|---|---|---|---|
| 3,491,774 | 1/1970 | Carbone | 132/9 |
| 3,538,617 | 11/1970 | Walters | 34/97 |
| 3,739,419 | 6/1973 | Natman | 15/187 |

*Primary Examiner*—G.E. McNeill

*Attorney, Agent, or Firm*—Merriam, Marshall, Shapiro & Klose

[57] ABSTRACT

A hair treating device comprises a hollow housing to which is affixed an air-cushioned type brush comprising an elastically deformable base which covers an opening in the housing and supports a plurality of external heat conducting teeth. The housing is provided with means for heating and directing a stream of air to the opening covered by the base, which is provided with suitable openings to permit the heated air to be directed towards the teeth of the brush.

3 Claims, 3 Drawing Figures

APPARATUS FOR TREATMENT AND CARE OF THE HAIR

The present invention relates to an apparatus for styling, particularly by brushing, and more generally for treating, shaping and arranging the hair.

A more specific aim of the invention is to provide an apparatus which combines the conventional treatment and care of the hair, that is to say tidying it and giving it form, with a heat effect intended to alter the shape of the hair, change the texture thereof to a more or less marked degree, resulting in the locks of hair being waved.

Apparatus are known which combine the mechanical effects of combing or brushing with a thermal effect, seeking on the one hand to dry wet hair and on the other hand to wave the locks or soften the general style of the hair.

These complex apparatuses generally aim to associate a comb or brush with an accessory procuring a heat effect in the form of an insufflation of hot air in the combing or brushing zone, the hot air being ejected through suitably positioned nozzles to reach the areas of the hair subjected at the same time to the mechanical hair tidying action.

However, these apparatuses most often realize simply a juxtaposition; this is doubtlessly advantageous insofar as it enables the hair to be combed and tidied at the moment when the hair is being dried by exposure to the flow of hot air; the two actions complement each other, the brushing or combing enabling the hair to be disentangled and separated and thus facilitating the passage of hot air, whilst said hot air makes the hair supple and more workable and therefore renders the mechanical action of the brush or comb more efficient.

However, although the accessories usefully enable the hair to be combed and dried at the same time, experience has shown that they are not very efficient when they are expected to shape and style the hair; this must most often be achieved by rollers or curlers having to be put in for a more or less prolonged period of time, this being combined with the action of heat provided by a flow of hot air directed by the conventional hair drier.

It is an object of the invention considerably to develop the possibilities of treating the hair allowing a much more intimate cooperation between the comb or brush and the source of heat.

In the hitherto known apparatus, the heat is in fact transmitted in the form of vector gas, a flow of hot air, which leaves the apparatus and reaches the hair directly, the brush or comb here only acting its normal mechaical role of tidying the hair.

Under these conditions, it is understood how the flow of hot air, although it allows a fairly rapid drying action, remains inefficient for obtaining a curving or waving of the hair, unless the air is of high temperature, which will risk burning the scalp, which is intolerable.

The invention intends to remedy these drawbacks and seeks to effect, in one action, a brushing or combing action on the hair combined with a possible drying of the locks, allowing a direct thermal action on the air, which results in the effects of waving and curving desired by the user.

To this end, the invention relates to an accessory for the treatment, care and beautifiying of the hair, comprising an air-cushion type brush constituted by a convex piece made of elastically deformable material, this convex piece supporting a plurality of teeth made of metal or any other heat-conducting material, the convex piece being pierced with a plurality of holes, and the inner face thereof closing a chamber communicating with a source of hot air, the holes in the convex piece acting as hot air ejecting nozzles, said hot air licking the teeth of the brush.

The apparatus preferably further comprises a fan and a source of heat in the form of an electrical resistance.

For example, the brush comprises a lead that may be connected to the mains, thus providing electrical current for the fan and the heating resistance.

For example, the resistance is integrated in the handle of the brush downstream of the fan, said latter blowing a jet of air over the resistance which is heated thereby and which reaches the chamber constituted by the inner face of the convex piece and the frame of the air-cushion brush, through suitable conduits.

In this embodiment, a brush is obtained whose heat-conducting teeth, mounted on the elastically deformable convex piece can therefore be displaced from their rest position to be adapted to the pulling effects and deformations undergone when the brush passes through hair in disorder, the elastic action of the convex piece tending to return the tooth into its normal or radial position with respect to the concave surface of the convex piece.

The brush makes it possible, in addition, to heat the area of the hair subjected to the brushing action, by the flow of hot air.

In addition, and this action is specific of the brush according to the invention, the tooth is itself subjected to the flow of hot air, on the one hand when the brush is in action in the air but especially when the user manipulates the brush between two brushing or combing strokes; the teeth made of heat-conducted material are therefore to a high temperature; this rise in temperature is also obtained by the action of the hot air contained in the inner chamber constituted by the rear face of the convex piece and the frame of the brush and which permanently contains a reserve of hot air escaping through the holes; the bottom of the teeth passing beyond the rear face of the convex piece is constantly subjected to the action of this hot air, this causing a rise in temperature of the whole tooth by the effect of conduction.

Under these conditions, all the teeth forming the air-cushion brush, brought to a sufficiently high temperature, penetrate into all the hair being brushed and which are in direct contact with these teeth. The thermal action exerted under these conditions on all the hair is much more direct and much more active, whilst in the prior known apparatuses the flow of hot air, projected at a certain speed, did not have the time to bring the hair to a suitable temperature and the heat was lost or risked directly contacting the scalp, causing an unpleasant burning sensation and risking affecting the root of the air.

In the apparatus according to the invention, these disadvantages are obviated by the teeth of the air-cushion brush working not only by mechanical action but also by thermal action, these teeth being brought, in novel manner, to a temperature allowing them to act directly on the hair.

All the hair contacted more or less rapidly, according to the movement of the user, by the teeth may then receive the desired effect of curving and twisting, giving the hair a pleasant bouffant effect.

It is also possible for the user to roll up the locks of hair by more or less accentuating this twisting movement.

The invention will be more readily understood from the following description given with reference to the accompanying drawings, in which.

Figures 1, 2, 3:
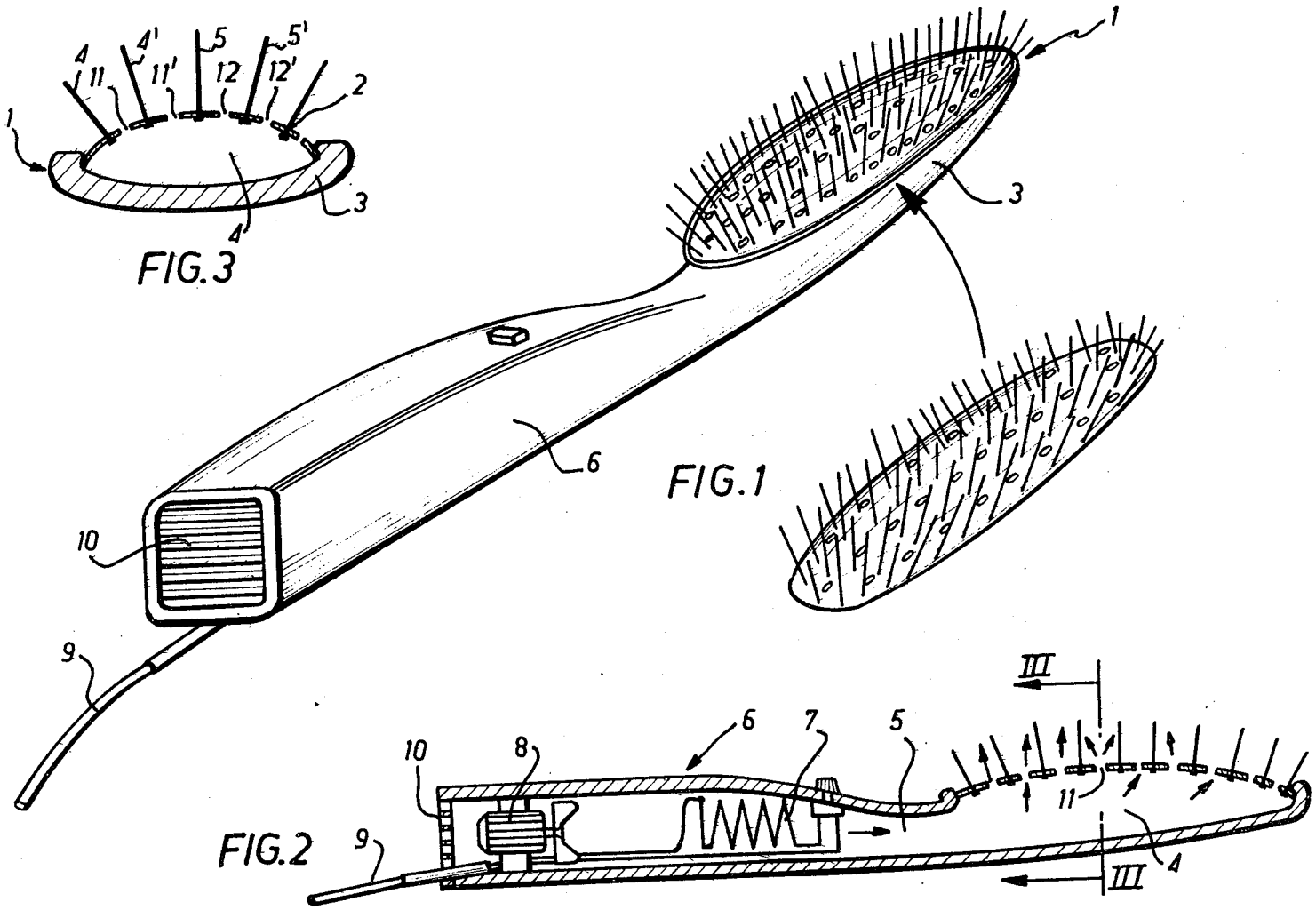
FIG. 1 is a perspective view of the apparatus according to the invention.
FIG. 2 is a view in longitudinal section of the apparatus shown in FIG. 1.
FIG. 3 is a view in transverse section along the line III—III of FIG. 2.

Referring now to the drawings, the figures show that the accessory according to the invention is constituted, at its active end in contact wih the hair, by an air-cushion type brush; the brush 1 is consequently constituted by a convex piece 2 made of a supple and elastically deformable material such as rubber. This convex piece 2 is fixed in a frame 3 and is planted with teeth 4, 4′, 5, 5′ made of metal or any other heat-conducting material. The inner face of the convex piece 2 faces a chamber 4 which it encloses; this chamber 4 is in communication, through conduit 5, with the chamber constituted by the internal space in the handle 6; this latter contains a heating resistance 7 and a fan 8 fed either by a battery incorporated in the apparatus or, as in the present example, by the load 9 connected to the mains supply.

It is seen that the air drawn in by the fan 8 through the perforated face 10 is pulsated into the internal space in the handle, passing over the resistance 7 by which it is heated; the hot air is then guided into chamber 4 from where it is evacuated through holes 11, 11′, 12, 12′ made in the wall of the convex piece; the escaping air licks the heat-conducting teeth 4, 4′, 5, 5′, which are rapidly brought to a high temperature and therefore exert a direct action of heat by conduction on the hair with which the teeth are brought into contact The bottoms of said teeth pass through the convex piece into the chamber 4 and are thus brought to a high temperature of suitable degree.

It will be noted that during a period of non-use, for example between two brushing strokes, the hot air nevertheless continues to lick the teeth and to heat said latter which are thus maintained at and returned to a suitable temperature permitting direct acton on the hair.

An overall effect is thus obtained which enables the locks to be heated by the passage of hot air which dries the hair and makes it supple; the teeth of the brush bring said locks into order whilst they also act by thermal effect to give the hair, by superficial heating of the walls thereof, the waves and desired texture resulting in a waving, styling or shaping according to the tendencies of the fashion or the user's wish. An apparatus is thus obtained which optimises the mechanical and thermal effects by combining and accumulating their action; the apparatus according to the invention will therefore be usable not only in the hands of professional hairdressers who will find therein a tool enabling him to work and style the hair under considerably improved conditions of efficiency and rapidity; the apparatus of the invention will also be useful to the individual user who will be able, in her daily hair care, to obtain in the desired presentation and style.

What is claimed is:

1. A hair treating device comprising a housing, heating means disposed within said housing, an air-cushion type brush mounted upon said housing, said air-cushion type brush having a convex piece made of an elastically deformable material supporting a plurality of external teeth made of heat-conducting material, hole means mounted upon said housing and means for directing heated air from said housing through said hole means towards said teeth of the air cushion type brush.

2. A hair treating device comprising a housing provided with an opening, heating means disposed within said housing, an air-cushion type brush having a convex piece made of an elastically deformable material supporting a plurality of external teeth made of heat conducting material, said convex piece closing said opening and being pierced with holes, and means for directing heated air from said housing through said holes of said convex piece towards said teeth of the air cushion type brush.

3. A hair treating device according to claim 2, wherein said convex piece is pierced with a plurality of holes distributed between said teeth.

* * * * *

UNITED STATES PATENT AND TRADEMARK OFFICE

CERTIFICATE OF CORRECTION

PATENT NO. : 3,970,093

DATED : July 20, 1976

INVENTOR(S) : Robert A. Lardenois

It is certified that error appears in the above-identified patent and that said Letters Patent are hereby corrected as shown below:

Col. 1, line 53 "mechaical" should be

--mechanical--

Col. 4, line 2 "acton" should be

--action--

Col. 4, claim 2, line 34, after "air-cushion type brush" insert --mounted upon said housing, said air-cushion type brush--.

Signed and Sealed this

Twenty-first Day of September 1976

[SEAL]

*Attest:*

RUTH C. MASON
*Attesting Officer*

C. MARSHALL DANN
*Commissioner of Patents and Trademarks*